US009524735B2

(12) United States Patent
Iyengar et al.

(10) Patent No.: US 9,524,735 B2
(45) Date of Patent: Dec. 20, 2016

(54) THRESHOLD ADAPTATION IN TWO-CHANNEL NOISE ESTIMATION AND VOICE ACTIVITY DETECTION

(71) Applicant: Apple Inc., Cupertino, CA (US)

(72) Inventors: Vasu Iyengar, Pleasanton, CA (US); Aram M. Lindahl, Menlo Park, CA (US)

(73) Assignee: Apple Inc., Cupertino, CA (US)

( * ) Notice: Subject to any disclaimer, the term of this patent is extended or adjusted under 35 U.S.C. 154(b) by 54 days.

(21) Appl. No.: 14/170,136

(22) Filed: Jan. 31, 2014

(65) Prior Publication Data

US 2015/0221322 A1 Aug. 6, 2015

(51) Int. Cl.

| | |
|---|---|
| ***G10L 25/84*** | (2013.01) |
| *G10L 25/78* | (2013.01) |
| *G10L 21/0216* | (2013.01) |

(52) U.S. Cl.

CPC ..... *G10L 25/84* (2013.01); *G10L 2021/02165* (2013.01); *G10L 2025/786* (2013.01)

(58) Field of Classification Search

CPC ..... G10L 21/0208; G10L 25/84

See application file for complete search history.

(56) References Cited

U.S. PATENT DOCUMENTS

| | | | | |
|---|---|---|---|---|
| 6,898,566 | B1 * | 5/2005 | Benyassine | G10L 19/22 704/207 |
| 7,536,301 | B2 | 5/2009 | Jaklitsch et al. | |
| 7,761,106 | B2 | 7/2010 | Konchitsky | |
| 8,019,091 | B2 | 9/2011 | Burnett et al. | |
| 8,046,219 | B2 | 10/2011 | Zurek et al. | |
| 8,194,882 | B2 | 6/2012 | Every et al. | |
| 8,204,252 | B1 | 6/2012 | Avendano | |
| 8,204,253 | B1 | 6/2012 | Solbach | |
| 8,275,609 | B2 | 9/2012 | Wang | |
| 8,521,530 | B1 | 8/2013 | Every et al. | |
| 2003/0179888 | A1 * | 9/2003 | Burnett | G10L 21/0208 381/71.8 |
| 2004/0181397 | A1 * | 9/2004 | Gao | G10L 19/005 704/207 |
| 2007/0230712 | A1 | 10/2007 | Belt et al. | |
| 2007/0237339 | A1 | 10/2007 | Konchitsky | |
| 2007/0274552 | A1 | 11/2007 | Konchitsky et al. | |
| 2008/0201138 | A1 | 8/2008 | Visser et al. | |
| 2009/0190769 | A1 | 7/2009 | Wang et al. | |
| 2009/0196429 | A1 | 8/2009 | Ramakrishnan et al. | |
| 2009/0220107 | A1 | 9/2009 | Every et al. | |

(Continued)

OTHER PUBLICATIONS

Sound Basics, Acoustic and vibrations. Internet document at: http://www.acousticvibration.com/sound-basis.htm, Admitted Prior Art, (3 pages).

(Continued)

*Primary Examiner* — King Poon
*Assistant Examiner* — Ibrahim Siddo
(74) *Attorney, Agent, or Firm* — Blakely, Sokoloff, Taylor & Zafman LLP

(57) ABSTRACT

A method for adapting a threshold used in multi-channel audio voice activity detection. Strengths of primary and secondary sound pick up channels are computed. A separation, being a measure of difference between the strengths of the primary and secondary channels, is also computed. An analysis of the peaks in separation is performed, e.g. using a leaky peak capture function that captures a peak in the separation and then decays over time, or using a sliding window min-max detector. A threshold that is to be used in a voice activity detection (VAD) process is adjusted, in accordance with the analysis of the peaks. Other embodiments are also described and claimed.

22 Claims, 7 Drawing Sheets

(56) References Cited

U.S. PATENT DOCUMENTS

| | | | | |
|---|---|---|---|---|
| 2010/0081487 | A1 | 4/2010 | Chen et al. | |
| 2010/0091525 | A1* | 4/2010 | Lalithambika | H02M 1/08 363/21.02 |
| 2010/0100374 | A1 | 4/2010 | Park et al. | |
| 2011/0106533 | A1 | 5/2011 | Yu | |
| 2011/0317848 | A1 | 12/2011 | Ivanov et al. | |
| 2012/0121100 | A1 | 5/2012 | Zhang et al. | |
| 2012/0130713 | A1* | 5/2012 | Shin | G10L 25/78 704/233 |
| 2012/0185246 | A1 | 7/2012 | Zhang et al. | |
| 2012/0209601 | A1 | 8/2012 | Jing | |
| 2012/0310640 | A1 | 12/2012 | Kwatra et al. | |
| 2013/0054231 | A1 | 2/2013 | Jeub | |
| 2013/0282372 | A1 | 10/2013 | Visser et al. | |
| 2014/0126745 | A1 | 5/2014 | Dickins et al. | |

OTHER PUBLICATIONS

Khoa, Pham C., "Noise Robust Voice Activity Detection", Nanyang Technological University, School of Computer Engineering, a thesis, 2012, Admitted Prior Art, (Title page, pp. i-ix, and pp. 1-26).

Jeub, Marco , et al., "Noise Reduction for Dual-Microphone Mobile Phones Exploiting Power Level Differences", *Acoustics, Speech and Signal Processing* (*ICASSP*), *2012 IEEE International Conference*, Mar. 25-30, 2012, ISSN: 1520-6149, E-ISBN: 978-1-4673-0044-5, pp. 1693-1696.

Nemer, Elias , "Acoustic Noise Reduction for Mobile Telephony", *Nortel Networks*, Admitted Prior Art, 17 pages.

Schwander, Teresa , et al., "Effect of Two-Microphone Noise Reduction on Speech Recognition by Normal-Hearing Listeners", *Journal of Rehabilitation Research and Development*, vol. 24, No. 4, Fall 1987, pp. 87-92.

Tashev, Ivan , et al., "Microphone Array for Headset with Spatial Noise Suppressor", Microsoft Research, One Microsoft Way, Redmond, WA, USA, *In Proceedings of Ninth International Workshop on Acoustics, Echo and Noise Control*, Sep. 2005, 4 pages.

Verteletskaya, Ekaterina , et al., "Noise Reduction Based on Modified Spectral Subtraction Method", *IAENG International Journal of Computer Science*, 38:1, IJCS_38_1_10, (Advanced online publication: Feb. 10, 2011), 7 pages.

Widrow, Bernard , et al., "Adaptive Noise Cancelling: Principles and Applications", *Proceedings of the IEEE*, vol. 63, No. 12, Dec. 1975, ISSN: 0018-9219, pp. 1692-1716 and 1 additional page.

* cited by examiner

THRESHOLD ADAPTATION IN TWO-CHANNEL NOISE ESTIMATION AND VOICE ACTIVITY DETECTION

An embodiment of the invention relates to audio digital signal processing techniques for two-microphone noise estimation and voice activity detection in a mobile phone (handset) device. Other embodiments are also described.

BACKGROUND

Mobile communication systems allow a mobile phone to be used in different environments such that the voice of the near end user is mixed with a variety of types and levels of background noise surrounding the near end user. Mobile phones now have at least two microphones, a primary or "bottom" microphone, and a secondary or "top" microphone, both of which will pick up both the near-end user's voice and background noise. A digital noise suppression algorithm is applied that processes the two microphone signals, so as to reduce the amount of the background noise that is present in the primary signal. This helps make the near user's voice more intelligible for the far end user.

The noise suppression algorithms need an accurate estimate of the noise spectrum, so that they can apply the correct amount of attenuation to the primary signal. Too much attenuation will muffle the near end user's speech, while not enough will allow background noise to overwhelm the speech. Examples of other noise suppression algorithms include variants of Dynamic Wiener filtering such as power spectral subtraction and magnitude spectral subtraction.

To obtain an accurate noise estimate, a voice activity detection (VAD) function may be used that processes the microphone signals (e.g., computes their strength difference on a per frequency bin and per frame basis) to indicate which frequency bins (in a given frame of the primary signal) are likely speech, and which ones are likely non-speech (noise). The VAD function uses at least one threshold in order to provide its decision. These thresholds can be tuned during testing, to find the right compromise for a variety of "in-the-field" background noise environments and different ways in which the user holds the mobile phone when talking. When the difference between the microphone signals is greater, as per the selected threshold, speech is indicated; and when the difference is smaller, noise is indicated. Such VAD decisions are then used to produce a full spectrum noise estimate (using information in one or both of the two microphone signals).

SUMMARY

When a mobile phone is located in the far field of an acoustic noise source, the noise manifests itself as essentially equal sound pressure level on both a primary (e.g., voice or bottom) microphone and a secondary (e.g., reference or top) microphone of the device. However, there are some acoustic environments in which the pressures will not be equal but will differ by several decibels (dB). For example, in the case of presumed equal pressure, a relatively low VAD threshold may be sufficient in theory, to discriminate between speech and noise. But in practice a somewhat higher VAD threshold over a wider range may be needed, to obtain proper discrimination between speech and noise (in order to for example produce an accurate noise estimate). Also, the bottom microphone usually detects higher sound pressure (than the top microphone) while the user is talking and holding the mobile phone device close to his mouth.

However, depending on the holding position of the device and diffraction effects around the head of the user, the observed pressure difference in practice may vary significantly. It has been found that the compromise of a fixed VAD threshold is not adequate, given the different acoustic environments in which a mobile phone is used and the resulting inaccurate noise estimates that are produced.

An embodiment of the invention is a technique that can automatically adjust or adapt a VAD threshold during in-the-field use of a mobile phone, in such a way that a noise estimate, computed using the VAD decisions, better reflects the actual level of background noise in which the mobile phone finds itself. This may help automatically adapt the VAD and the noise estimation processes to different background noise environments (e.g., when a user while on a phone call is wearing a hat or is standing next to a wall) and to the different ways in which the user can hold the mobile phone.

In one aspect, a method for adapting a threshold used in multi-channel audio noise estimation can proceed as follows. Strengths of primary and secondary sound pick up channels are computed. A separation parameter is also computed, being a measure of difference between the strengths of the primary and secondary channels that is due to the user's voice being picked up by the primary channel. In the case of a mobile phone handset device, it has been found that the greatest or peak separation is most often caused by the talker or local user's voice, not by far field noise or transient distractors. This is true in most holding positions of the handset device. Accordingly, a proper analysis of the peaks in the separation function (separation vs. time curve) should be able to inform how to correctly adjust a threshold that is then used in a noise estimation process, or in a voice activity detection (VAD) process' decision stage. The resulting threshold adjustment will appropriately reflect the changing local user's voice, ambient environment and/or device holding position.

In one embodiment, the peak analysis involves computing a leaky peak capture function of the separation. This function captures a peak in the separation, and then decays over time. A threshold that is to be used in an audio noise estimation process is then adjusted, in accordance with the leaky peak capture function. The threshold may be a voice activity detector (VAD) threshold that is used in the audio noise estimation process. In another embodiment, the peak analysis involves a sliding window min-max detector whose output (representing a suitable peak in the separation data) does not decay but rather can "jump" upward or downward depending upon the detected suitable peak.

In one aspect, the current value of the leaky peak capture function can be updated to a new value, e.g. in accordance with the measured separation being greater than a previous value of the leaky peak capture function, only when the probability of speech during the measurement interval is sufficiently high, not when the probability of speech is low. Any suitable speech indicator can be used for this purpose.

Similarly, a min-max measurement made in a given window, by the sliding window detector, can be accepted only if the probability of speech covering that window is sufficiently high; the detector output otherwise remains unchanged. Any suitable speech indicator can be used for this purpose.

In another aspect, a method for adapting a threshold used in multi-channel audio voice activity detection (VAD) can proceed as follows. Strengths of primary and secondary sound pick up channels are computed. A separation parameter is also computed, being a measure of difference between the strengths of the primary and secondary channels that is due to the users voice being picked up by at least the primary channel.

In one embodiment of the method, a leaky peak capture function of the separation is computed. This function captures a peak in the separation, and then decays over time. A threshold that is to be used in a voice activity detection (VAD) process is then adjusted in accordance with the function. Decisions by the VAD process may then be used in a variety of different speech-related applications, such as speech coding, diarization and speech recognition. In another embodiment of the method, a sliding window min-max detector is used to capture peaks in the separation (without a decaying characteristic). Other peak analysis techniques that can reliably detect the peaks that are due to voice activity, rather than transient background sounds, may be used in the method.

In yet another aspect, an audio device has audio signal processing circuitry that is coupled to first and second microphones, where the first microphone is positioned near a user's mouth while the second microphone is positioned far from the user's mouth. The circuitry computes separation, being a measure of how much a signal produced by the first microphone is different than a signal produced by the second microphone (due to the user's voice being picked by the first microphone), and performs peak analysis of the separation. The circuitry is to then adjust a voice activity detection (VAD) threshold in accordance with the peak analysis. More generally, the audio signal processing circuitry may be designed to compute separation as a measure of how much a signal produced by a first sound pickup channel is different than a signal produced by a second sound pickup channel; the first channel picks up primarily a talker's voice while the second channel picks up primarily the ambient or background. For example, the circuitry may be capable of performing a digital signal processing-based sound pickup beam forming process that processes the output audio signals from a microphone array (e.g., multiple acoustic microphones that are integrated in a single housing of the audio device) to generate the two audio channels. As an example of such of a beam forming process, one beam would be oriented in the direction of an intended talker while another beam would have a null in that same direction.

The techniques here will often be mentioned in the context of VAD and noise estimation performed upon an uplink communications signal used by a telephony application, i.e. phone calls, namely voice or video calls. It has been discovered that such techniques may be effective in improving speech intelligibility at the far end of the call, by applying noise suppression to the mixture of near end speech and ambient noise (contained in the uplink signal), before passing the uplink signal to for example a cellular network vocoder, an internet telephony vocoder, or simply a plain old telephone service transmission circuit. However, the techniques here are also applicable to VAD and noise suppression performed on a recorded audio channel during for example an interview session in which the voices of one or more users are simply being recorded.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

Several embodiments of the invention with reference to the appended drawings are now explained. While numerous details are set forth, it is understood that some embodiments of the invention may be practiced without these details. In other instances, well-known circuits, structures, and techniques have not been shown in detail so as not to obscure the understanding of this description.

Figure 1:
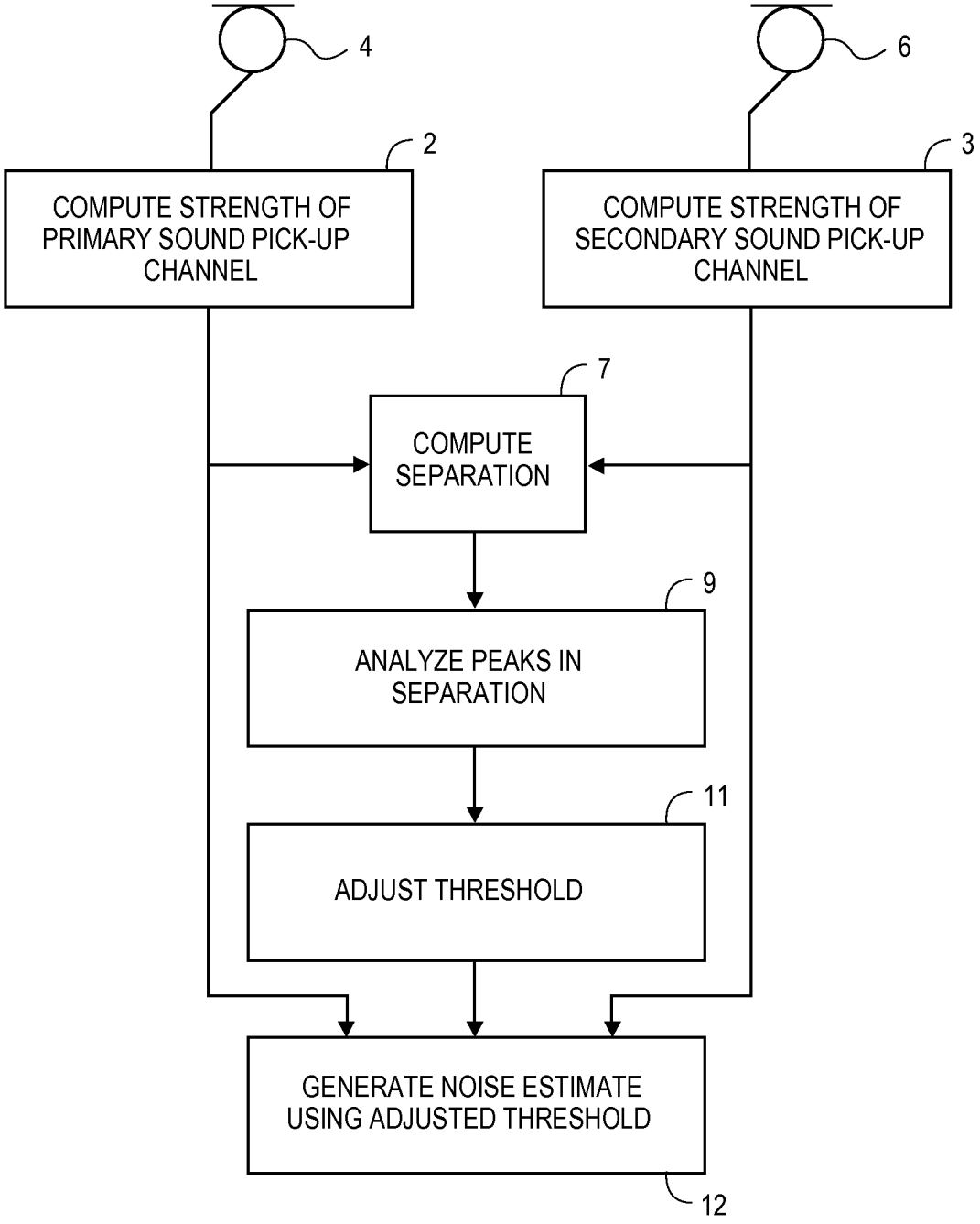
FIG. 1 depicts a flow diagram of a process for adapting a threshold used in multi-channel audio noise estimation.
Figure 2:
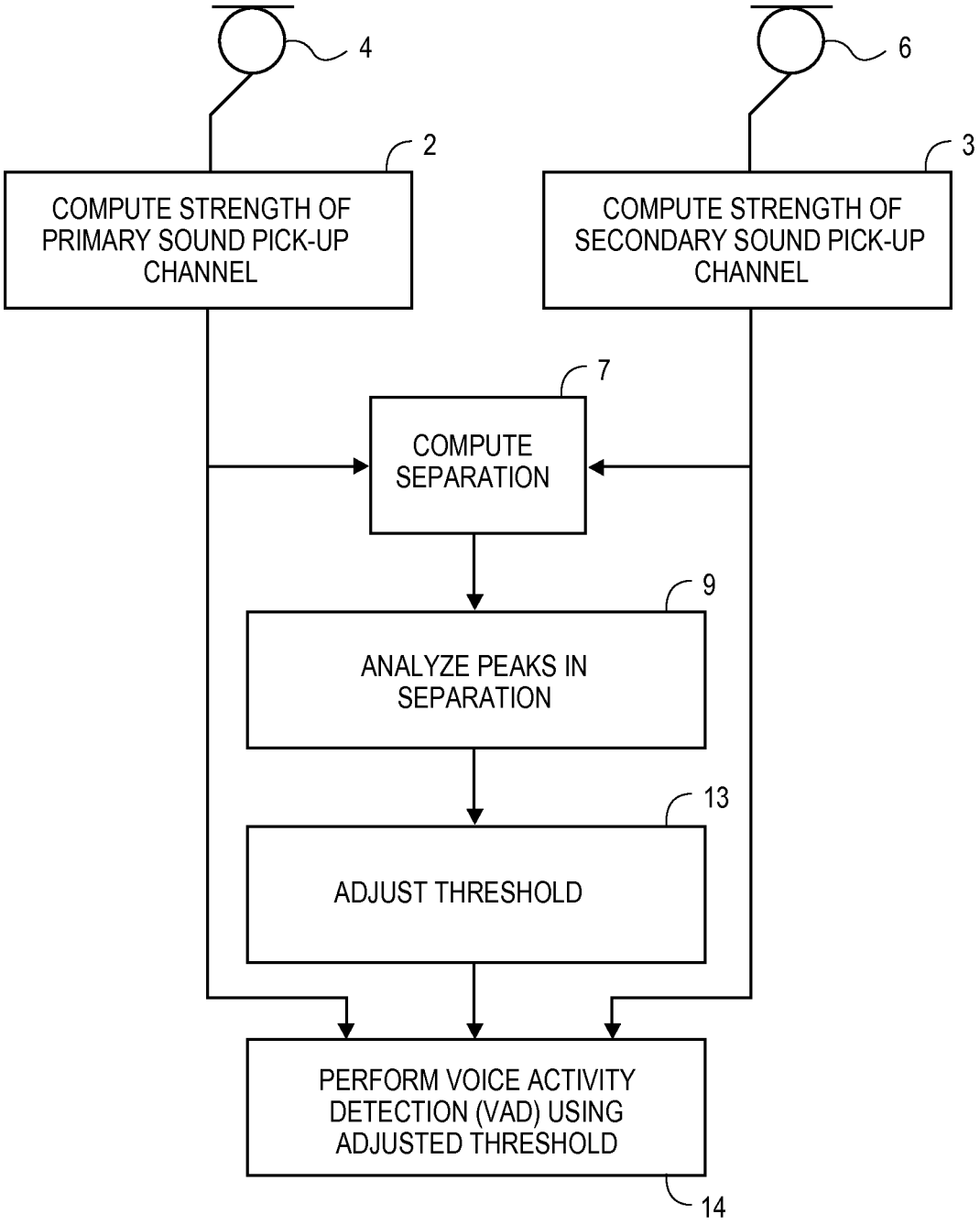
FIG. 2 depicts a flow diagram of a process for adapting a threshold used in multi-channel voice activity detection.
Figure 3:
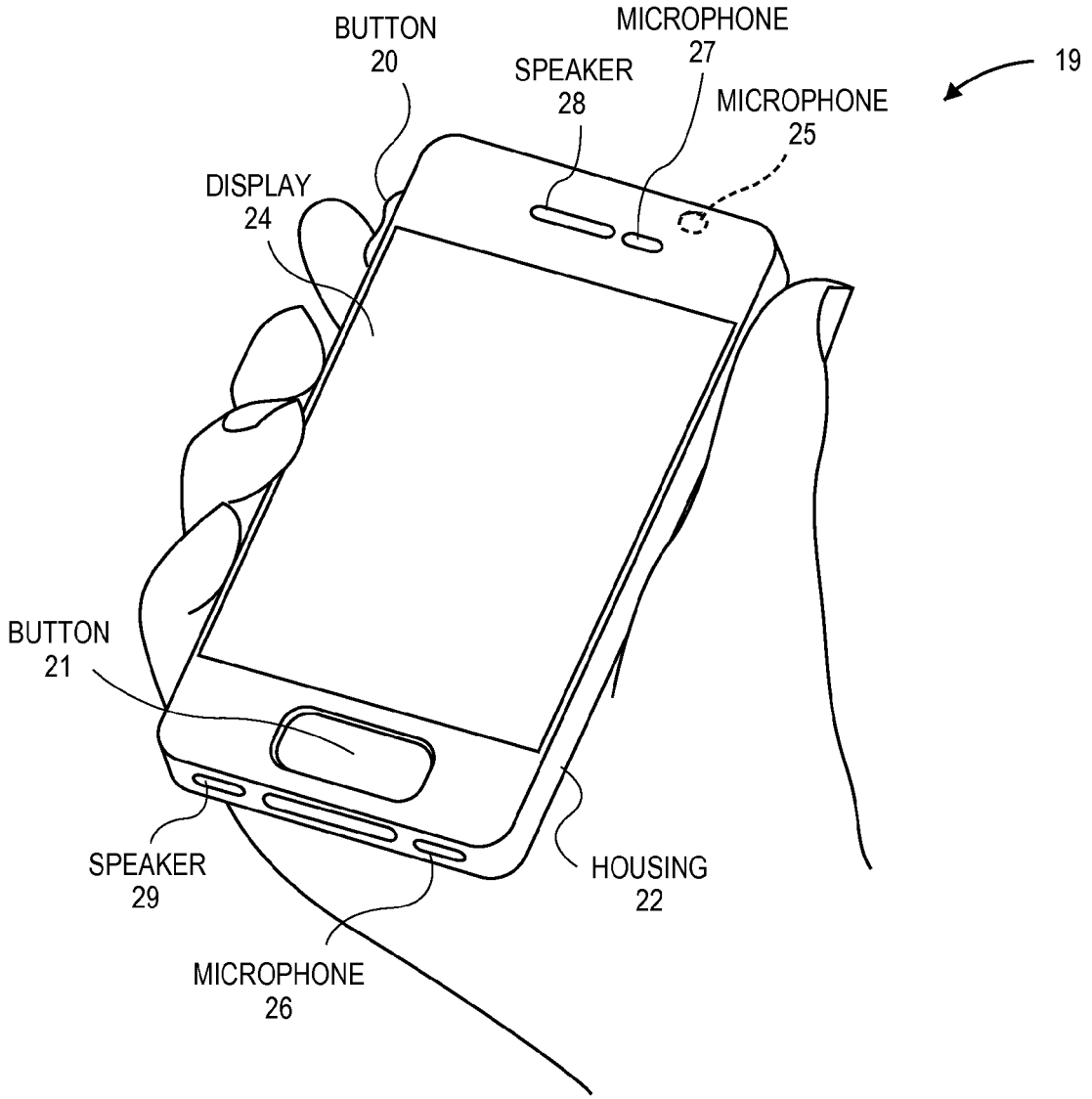
FIG. 3 illustrates a mobile phone being one example of an audio device in which the processes of FIG. 1 and FIG. 2 may be implemented.

FIG. 1 depicts a flow diagram of a process for adapting a threshold used in multi-channel audio noise estimation, while FIG. 2 is a flow diagram of a similar process for adapting a threshold for performing voice activity detection (VAD) in general. In both cases, the process uses two sound-pick up channels, primary and secondary, which are produced by microphone circuits 4, 6, respectively. In the case where the process is running in an otherwise typical mobile phone that is being used in handset mode (or against-the-ear use), the microphone circuit 4 produces a signal from a single acoustic microphone that is closer to the mouth (e.g., the bottom or talker microphone), while the microphone circuit 6 produces a signal from a single acoustic microphone that is farther from the mouth (e.g., the top microphone or reference microphone, not the error microphone). FIG. 3 depicts an example of a mobile device 19 being a smart phone in which an embodiment of the invention may be implemented. In this case, the microphone circuit 6 includes a top microphone 25, while the microphone circuit 4 includes a bottom microphone 26. The housing 22 also includes an error microphone 27 that is located adjacent to the earpiece speaker (receiver) 28. More generally however, the microphone circuits 4, 6 represent any audio pick up subsystem that generates two sound pick-up or audio channels, namely one that picks up primarily a talker's voice and the other the ambient or background. For example, a sound pickup beam forming process with a microphone array can be used, to create the two audio channels, for instance as one beam in the direction of an intended talker and another beam that has a null in that same direction.

Returning to the flow diagram in FIG. 1, the process continues with computing the strengths of the primary and secondary sound pick up channels (operations 2, 3). In one embodiment, the strengths of the primary and secondary channels are computed as energy or power spectra, in the spectral or frequency domain. This may be based on having first transformed the digital audio signals on a frame by frame basis (produced by the respective microphone circuits 4, 6) into the frequency domain, using for example a Fast Fourier Transform or other suitable discrete time to spectral domain transform. This approach may lead to the noise estimate (produced subsequently, in operation 12) also being computed in the spectral domain. In such an embodiment, the noise estimate, and the strengths of the primary and secondary channels, may be given by sequences of discrete-time vectors, wherein each vector has a number of values associated with a corresponding number of frequency bins and corresponds to a respective frame or time interval of a primary or secondary digital audio signal. Alternatively, the strengths of the primary and secondary sound pick up channels may be computed in the discrete time domain.

The process continues with operation 7 in which a parameter referred to here as separation, or voice separation, is computed. Separation is a measure of the difference between the strengths of the primary and secondary channels that is due to the user's voice having been picked up by the primary channel. As suggested above, separation may be computed in the spectral domain on a per frequency bin basis, and on a per frame basis. In other words, separation may be a sequence of discrete-time vectors, wherein each vector has a number of values associated with a corresponding number of frequency bins, and wherein each vector corresponds to a respective frame of digital audio. It should be noted that while an audio signal can be digitized or sampled into frames, that are each for example between 5-50 milliseconds long, there may be some time overlap between consecutive frames. Separation may be a statistical measure of the central tendency, e.g. average, of the difference between the two audio channels, as an aggregate of all audio frequency bins or alternatively across a limited band in which speech is expected (e.g., 400 Hz-1 kHz) or a limited number of frequency bins, computed for each frame. Separation may be high when the talker's voice is more prominently reflected in the primary channel than in the secondary channel, e.g. by about 14 dB or higher. Separation drops when the mobile device is no longer being held (by its user) in its "optimal" position, e.g. to about 10 dB, and drops even further in a high ambient noise environment, e.g. to just a few dB.

The process continues with operation 9 in which the peaks in separation are analyzed. In one embodiment, operation 9 involves computing a leaky peak capture function of the separation. This function captures a peak in the separation and then decays over time, so as to allow multiple peaks in the separation parameter to be captured (and identified). The decay rate is considered a slow decay or "leak", because it has been discovered that one or more shorter peaks that follow a higher peak soon thereafter, should not be captured by this function. In addition, it has been discovered that updating a current value of the function to a new value (in accordance with the separation being greater than a previous value of the function) should only take place when the probability of speech is high but not when the probability of speech is low. This may require also computing a probability of speech in a given frame, and using that result to determine whether the leaky peak function should be updated or whether it should be allowed to continue its decay (in that frame). Thus defined, the leaky peak capture function may be used to effectively detect which type of user environment the mobile device finds itself in, so that the correct threshold is then selected.

A general characteristic of the tradeoff in the choice of a VAD threshold is the following. A high VAD threshold will capture more transient noises which do not present equal pressure to both microphone circuits 4, 6. But a high threshold will also incorrectly cause voice components to be included in the subsequent noise estimate. This in turn results in excessive voice distortion and attenuation. A high threshold is also undesirable in very high ambient noise situations since voice separation drops in that case (despite voice activity).

The automatic process described here continues with operation 11 in which a threshold that is to be used in a noise estimation process (e.g., a VAD threshold) is adjusted in accordance with the leaky peak capture function. For instance, if the separation is high (as evidenced in the leaking peak capture function), then a VAD threshold is raised accordingly, to get better speech vs. noise discrimination; if the separation is low, then the VAD threshold is lowered accordingly. This helps generate a more accurate noise estimate using the adjusted threshold, which is performed in operation 12. In one embodiment, the threshold is adjusting by computing it as a linear combination of a current peak separation value (given by the leaky peak function), and a pre-determined margin value. In addition, the computed threshold may also be constrained to remain between pre-determined lower and upper bounds.

Generation of the noise estimate in operation 12 may be in accordance with any conventional technique. For example, a spectral component of the noise estimate may be selected or generated predominantly from the secondary channel, and not the primary channel, when strength of the primary channel is greater, as per the adjusted threshold, than strength of the secondary channel. In addition, when strength of the primary channel is not greater, as per the threshold, than strength of the secondary channel, then the spectral component of the noise estimate is selected or generated predominantly from the primary channel, and not the secondary channel. Note however that there may be multiple thresholds (for use when generating the noise estimate in operation 12) that can be adjusted in operation 11. Also, the creation of the noise estimate in operation 12 may be more complex than simply selecting a noise estimate sample (e.g., a spectral component) to be equal to one from either the primary channel or the secondary channel.

Figure 4:
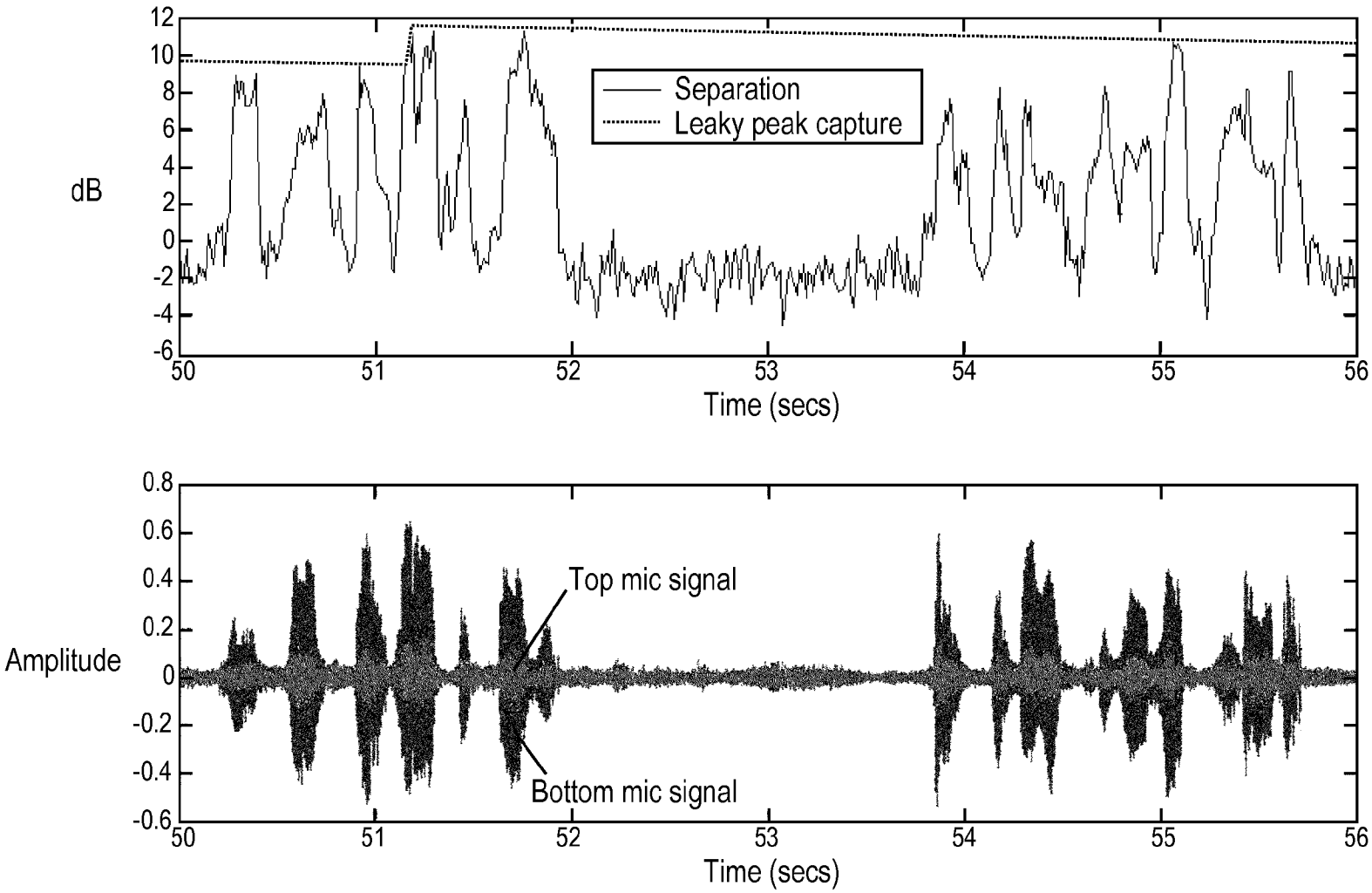
FIG. 4 contains example plots of a separation parameter and a corresponding leaky peak capture function, which have been computed based on examples of the primary and secondary sound pick up channels.
Figure 5:
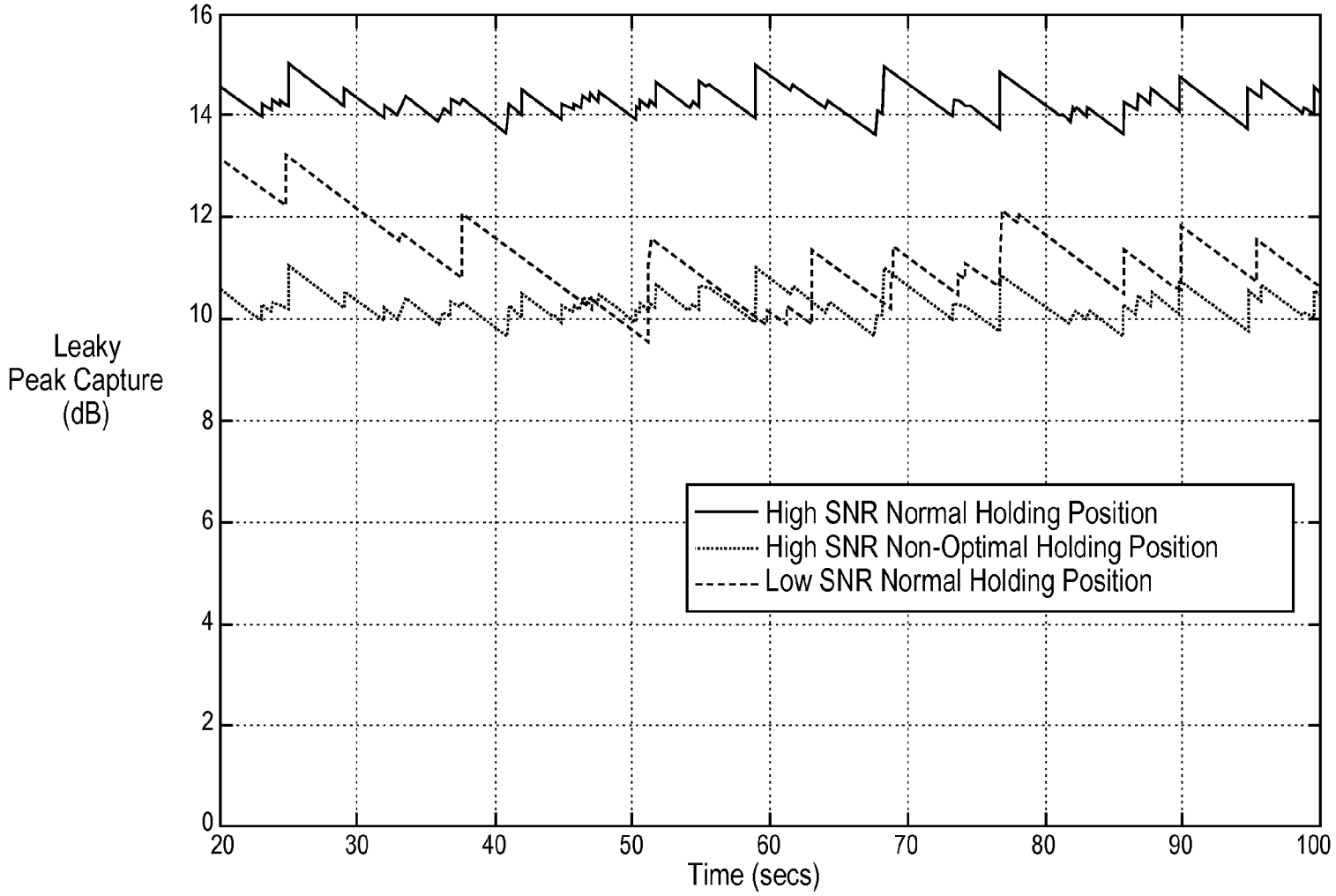
FIG. 5 shows three plots of a leaky peak capture function, computed for three different combinations of acoustic environment/device holding position.
Figure 6:
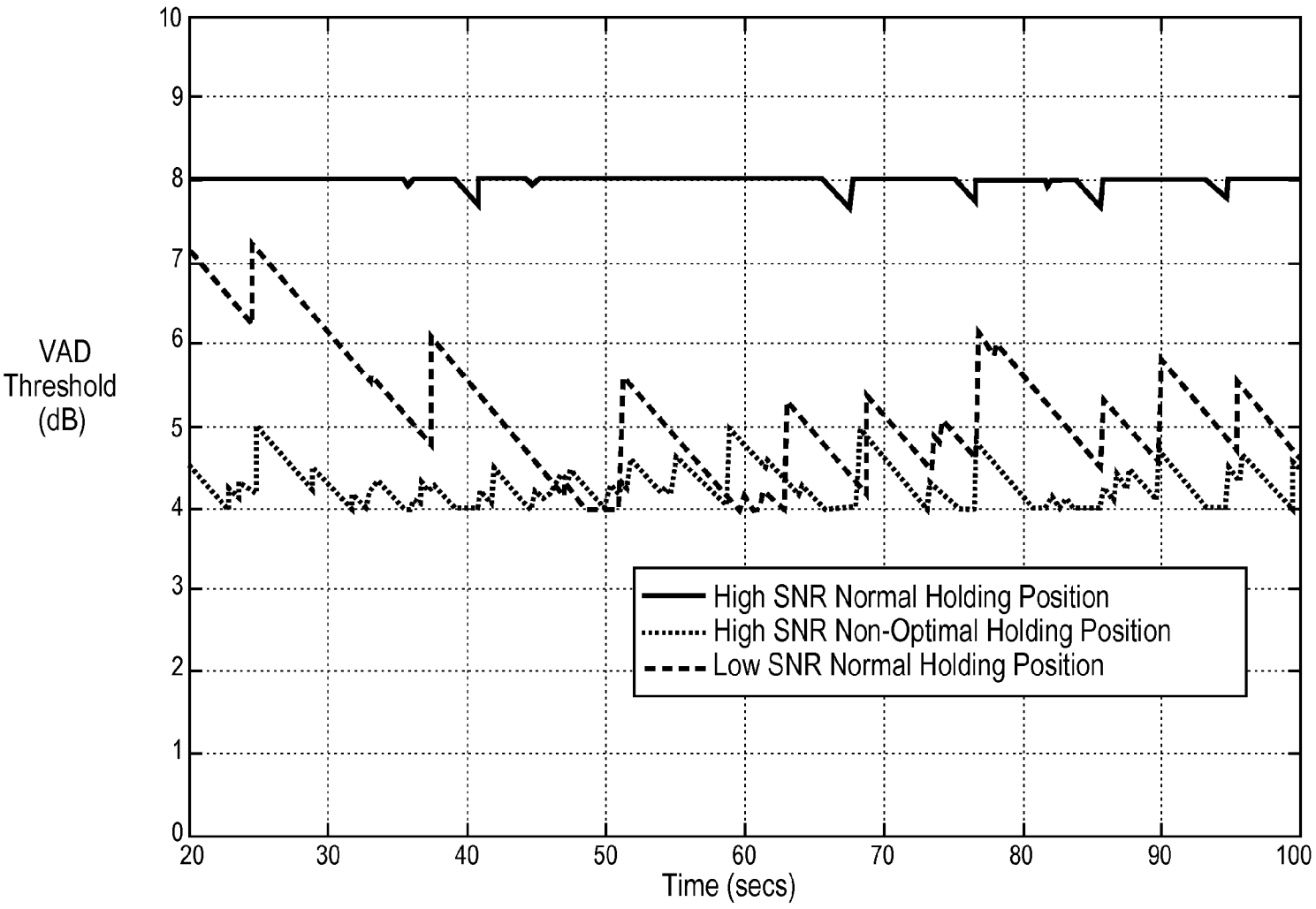
FIG. 6 illustrates three plots of an example VAD threshold parameter, computed based on the three leaky peak capture function plots of FIG. 5.

An example of the noise estimation process of FIG. 1 is now given using computer program source code, including details for each operation therein, also with reference to plots of the relevant parameters in such a process, as shown in FIGS. 4-6. The process is performed predominantly in the spectral domain, and on a per frame basis (a frame of the digitized audio signal), such that the primary and second channels are first transformed into frequency domain (e.g., using a FFT), before their raw power spectra are computed (these may correspond to operations 2, 3 in FIG. 1).

ps_pri=power spectrum of primary sound pick up signal.

ps_sec=power spectrum of secondary sound pick up signal.

The raw power spectra may then be time and frequency smoothed in accordance with any suitable conventional technique (may also be part of operations 2, 3).

Spri=Time and frequency smoothed spectrum of Primary channel.

Ssec=Time and frequency smoothed spectrum of Secondary channel.

Next, separation is computed (operation 7 of FIG. 1). An example of doing so is as follows:

$$\text{Separation}=1/N\Sigma_{i=1}^{N}(10\log PSpri(i)-10\log PSsec(i))$$

where N is the number of frequency bins, PSpri and PSsec are the power spectra of the primary and secondary channels, respectively, and i is the frequency index. Other ways of defining separation are possible.

The bottom plot in FIG. 4 shows an example of primary and secondary channels that have been recorded, indicated here as bottom and top microphone signals, respectively, of a mobile phone. These recordings were made in a not-so-high signal to noise ratio (SNR) condition, e.g. about 15 dB SNR, while the phone is being held at an optimal handset holding position. The top plot shows the computed separation parameter for this condition, using the equation above. In can be seen that during speech activity, the separation peaks at between 8 to 12 dB. In contrast, in a high SNR condition, such as in a quiet sound studio, the separation has been found to peak in excess of 12 dB and often closer to 14 dB. As a further contrast, in a condition where the phone is being held in a non-optimal position (such that the user's mouth is farther away from the bottom microphone), the peaks in the separation have been seen to drop to 10 dB.

The top plot in FIG. 4 also shows the leaky capture function superimposed with the separation computed using the following method.

```
% sep = Separation (VoiceSeparation)
% PSpri = Power Spectrum of primary channel (an array of values)
% PSsec = Power Spectrum of secondary channel (an array of values)
% bs = Block Size
% fs = Sampling Rate
dec = (bs / fs)*0.2; (e.g., 0.2dB / sec decay rate or "leak")
%prob_speech = Probability of Speech
% prob_speech_Threshold = Threshold to declare speech presence.
sep = mean( 10*log10(PSpri) - 10*log10(PSsec) );
peak_sep = peak_sep - dec;
if ( prob_speech > prob_speech_Threshold )
    if ( sep > peak_sep )
        peak_sep = sep;
    end
end
```

As suggested earlier, a type of peak detection function is needed that allows for detection of changing peaks over time. This may be obtained by adding a slow decay or leak to a peak capture process, hence the term leaky peak capture, to allow capture of changing peaks over time. The decay or leak can be seen in FIG. 4, for example following the first peak that is just after the 51 seconds mark. The decay in the leaky peak capture function should be slow enough to maintain a high value for the function, during long periods of no speech during a typical conversation. The example here is 0.2 dB/sec. If the selected decay is too fast, then the function will detect undesired peaks—this may then lead to the threshold being dropped too low. If the decay is too slow, then the process will adapt too slowly to the changing user environment—this may then lead to the threshold not be lowered soon enough. The decay rate may be investigated and tuned empirically in a laboratory setting, based on for example the waveforms shown, and may be different for different types or brands of mobile phones.

The above example for computing the leaky peak capture function also relies on computing a probability of speech for the frame. A current value of the leaky peak capture function is updated to a new value (in accordance with the separation being greater than a previous value of the function), only when the probability of speech is high but not when the probability of speech is low. Any known technique to compute the speech probability factor can be used here. The probability of speech is used to in effect gauge when to update the peak tracking (leaky peek capture) function. In other words, the function continues to leak (decay) and there is no need to update a peak, unless speech is likely.

FIG. 5 shows the leaky peak capture function computed for three different ambient noise and phone holding conditions, and plotted over a longer time interval than FIG. 4. The three conditions are high SNR (e.g., around 100 dB) with normal and non-optimal phone holding positions, and low SNR (e.g., around 15 dB) with normal phone holding position. The leaky peak capture function is updated only during speech presence, where the latter can be determined using a probability of speech computation, or alternatively an average that is formed using the individual VAD decisions in each frequency bin. As can be seen, when no speech activity is detected the leaky peak function slowly decays or leaks down, until it is pushed up by a peak (that occurs during high speech probability). The decay rate here is the same as the example above, namely 0.2 dB/sec, although in practice the decay rate can be tuned differently. There are at least two tuning parameters (for tuning the leaky peak capture function in a laboratory setting, for example), namely the decay/leak rate and the manner in which the probability of speech (prob_speech, in the program shown above) is determined, e.g. a threshold used to discriminate between speech and non-speech. FIG. 5 shows how the leaky peak capture function can clearly reveal when the phone is in a non-optimal holding position, and also when the phone is in a higher stationary noise, or in a transient noise ambient, e.g. babble or pub noise.

Returning briefly to FIG. 1 and in particular operation 11, the noise estimation process uses a threshold that is to be adjusted or adapted (automatically during in-the-field use of the mobile device), in accordance with the leaky peak capture function. In one embodiment, the threshold is a VAD threshold, namely a threshold that is used by a VAD decision making operation. An example of a noise estimation process that relies upon VAD decision making (in order to generate its noise estimate), and where the decision making is based on a fixed VAD threshold, is given below.

```
        beta = time constant for smoothing the noise estimate
        beta_1 = 1 - beta
Threshold = VAD decision making threshold
    % 2-channel noise estimate
    % non-vectorized implementation initially
    for ii=1:N % loop over all frequency bins
        % First check for voice activity
        if ( Spri(ii) > Ssec(ii)*Threshold )
            % Voice detect
            noise_sample = ps_sec(ii);
        else
            % Stationary or non-stationary noise
            noise_sample = ps_pri(ii);
        end
        % Now filter
        noise(ii) = noise(ii)*beta_1 + noise_sample*beta;
    end
```

The audio noise estimation portion of this algorithm generates a noise estimate (noise_sample) predominantly from the secondary channel PS_sec, and not the primary channel PS_pri, when strength of the primary channel is greater, as per the threshold, than strength of the secondary channel. Also in this algorithm, the noise estimate is predominantly from the primary channel and not the secondary channel, when strength of the primary channel is not greater, as per the threshold, than strength of the secondary channel. The parameter threshold plays a key role in the per-frequency-bin VAD decision-making process used here, and consequently the resulting noise estimate (noise_sample).

In one embodiment, the threshold parameter (VAD threshold) may be computed by the following algorithm:

VAD threshold = leaky peak capture − Margin
VAD threshold = max [ min(VAD threshold, upper bound), lower bound ]

The parameter Margin may be chosen to at least reduce (if not minimize) voice distortion and voice attenuation in the resulting signal produced by a subsequent noise suppression process (that uses the noise estimate obtained here to apply a noise suppression algorithm upon for example the primary sound pick up channel). In addition, the upper bound and lower bound are limits imposed on the resulting VAD threshold. FIG. 6 shows an "adaptive" VAD threshold that has been computed in this manner, for the same three different conditions of FIG. 5, based on Margin=6 dB, and lower and upper bounds of 4 dB and 8 dB, respectively. These are of course just examples; the Margin parameter as well as the upper and lower bounds may be tuned (in a laboratory setting for example), to be different depending upon the particular mobile device.

In general, FIG. 6 illustrates that in low noise conditions (e.g., high SNR) with normal holding position, a higher VAD threshold can be used, except that to capture transients the threshold should drop briefly and then recover (e.g., as seen at the 42, 67, 77, 85 and 95 second marks). But when the holding position of the phone is non-optimal, e.g. changing between close to the mouth and away from the mouth, then the threshold drops to a more conservative value (here between 4-5 dB) and essentially remains in that range, despite the high SNR. Also, in a noisy ambient where the SNR is low, even while the holding position is normal, the threshold varies significantly between high values (which are believed to result in speech being captured even during unusual noise transients), and low values (which may help maintain low voice distortion).

It should be noted here that the VAD threshold described above (and plotted as an example in FIG. 6) may be frequency dependent, so that a separate VAD threshold is computed for each desired frequency bin. In other words, each desired frequency bin could be associated with its respective, independent, adaptive VAD threshold. The threshold in that case may be a sequence of vectors, wherein each vector has a number of values associated with a number of frequency bins of interest, and where each vector corresponds to a respective frame of digital audio.

The operations 2, 3, 7, and 9 described above in connection with the noise estimation process of FIG. 1 may also be applied to adjust one or more thresholds that are used while performing VAD in general, i.e. not necessarily tied to a noise estimation process. This aspect is depicted in the flow diagram of FIG. 2 where the VAD threshold adjustment operation 13 may be different than one that is intended for producing a noise estimate or noise profile. In that case, a VAD operation 14 may be used for a purpose other than noise estimation, e.g. speech processing applications such as speech coding, diarization and speech recognition.

In another embodiment, a representative value (e.g., average value) of the leaky peak capture function can be stored in memory inside the mobile device, so as to be re-used as an initial value of the leaky peak capture function whenever an audio application is launched in the mobile device, e.g. when a phone call starts. In that case, the function decays starting with that initial value, until operation 9 in the processes of FIG. 1 and FIG. 2 encounters the situation where the function is to be updated with a new peak value.

While the threshold adaptation techniques described above may be used (for producing reliable VAD decisions and noise estimates) with any system that has at least two sound pick up channels, they are expected to provide a special advantage when used in personal mobile devices 19 that are subjected to varying ambient noise environments and user holding positions, such as tablet computers and mobile phone handsets. An example of the latter is depicted in FIG. 3, in which the typical elements of a mobile phone housing 22 has a display 24, menu button 21, volume button 20, loudspeaker 29 and an error microphone 27 integrated therein. Such an audio device includes a first microphone 26 (which is positioned near a user's mouth during use), a second microphone 25 (which is positioned far from the user's mouth), and audio signal processing circuitry (not shown) that is coupled to the first and second microphones. The circuitry may include analog to digital conversion circuitry, and digital audio signal processing circuitry (including hardwired logic in combination with a programmed processor) that is to compute separation, being a measure of how much a signal produced by the first microphone 26 is different than a signal produced by the second microphone 25. In addition, as described above, a leaky peak capture function of the separation is computed, wherein the function captures a peak in the separation and then decays over time. The circuitry is to then adjust a voice activity detection (VAD) threshold in accordance with the leaky peak capture function. The variations to the VAD and noise estimation processes described above in connection with FIGS. 1 and 2 are of course applicable in the context of a mobile phone, where the audio signal processing circuitry will be tasked with for example adjusting the VAD threshold in accordance with the leaky peak capture function during a phone call, while the user is participating in the call with the mobile phone housing positioned against her ear (in handset mode). For the sake conciseness, the rest of operations described above are not repeated here, although one of ordinary skill in the art will recognize that such operations may be performed by for example a suitably programmed digital processor inside the mobile phone housing.

It can be seen that in most instances, separation is a relatively fast calculation that can be done for essentially every frame, if desired. But the features of interest in separation (that are used for adjusting a VAD or noise estimation threshold) are those peaks that are actually due to the users voice, rather than due to some transient or non-stationary or directional background sound or noise event (which may exhibit a similar peak). An alternative inquiry here becomes when to observe the separation data so as to identify relevant peaks therein. This peak analysis, which is part of operation 9 introduced above in FIG. 1 and in FIG. 2, should be done in a way that can automatically, and quickly, adapt to significant changes in the user's ambient environment or to how the user is holding the device.

With above peak analysis goal in mind, it was recognized that separation often contains several "min-max-min" cycles (also referred to as min-max cycles) that are in a given amplitude range, and these are followed by other min-max cycles that are in a very different amplitude range, e.g. because the user changed how he is holding the device during a phone call. In most instances, it has been found that when the amplitude or distance between a trough and an immediately following peak is above a certain threshold, e.g. between about 5 dB and about 7 dB, that portion of the separation indicates a transition from the near user not talking to starting to talk.

In accordance with an embodiment of the invention, the peak analysis in operation 9 of FIG. 1 and FIG. 2 is performed using a sliding window min-max detector that updates its output (representing a suitable peak in separation), as follows. The detector will "scan" the separation data over a given time interval (window) in order to measure or detect a suitable minimum to maximum (min-max) transition therein (e.g., a subtraction or a ratio between a minimum value and a maximum value of separation). The interval should be just long enough to contain a period of inactivity by the user (i.e., the user is not talking) but not so long that the detector's ability to track changes in separation is diminished. For example, the interval may be, for example, between 0.5-2 seconds, or between 1-2 seconds. Note here that the resulting latency in updating for example a VAD threshold is not onerous, because the user's talking activity pattern and ambient acoustic environment in most instances continues essentially unchanged beyond such a delay interval, thereby allowing the delayed VAD threshold decision to still be applicable.

A detected transition or min-max excursion in a given interval may be deemed suitable only if it is large enough (e.g., greater than 5 dB, or perhaps greater than 7 dB). If a suitable transition is found, then the detector output may be updated with a new peak value, e.g. the maximum value of the detected, suitable transition. The detector window is then moved forward in time (by a predetermined amount), before another attempt is made to find a suitable min-max transition in the separation data; if none is found, then the output of the detector is not updated.

Figure 7:
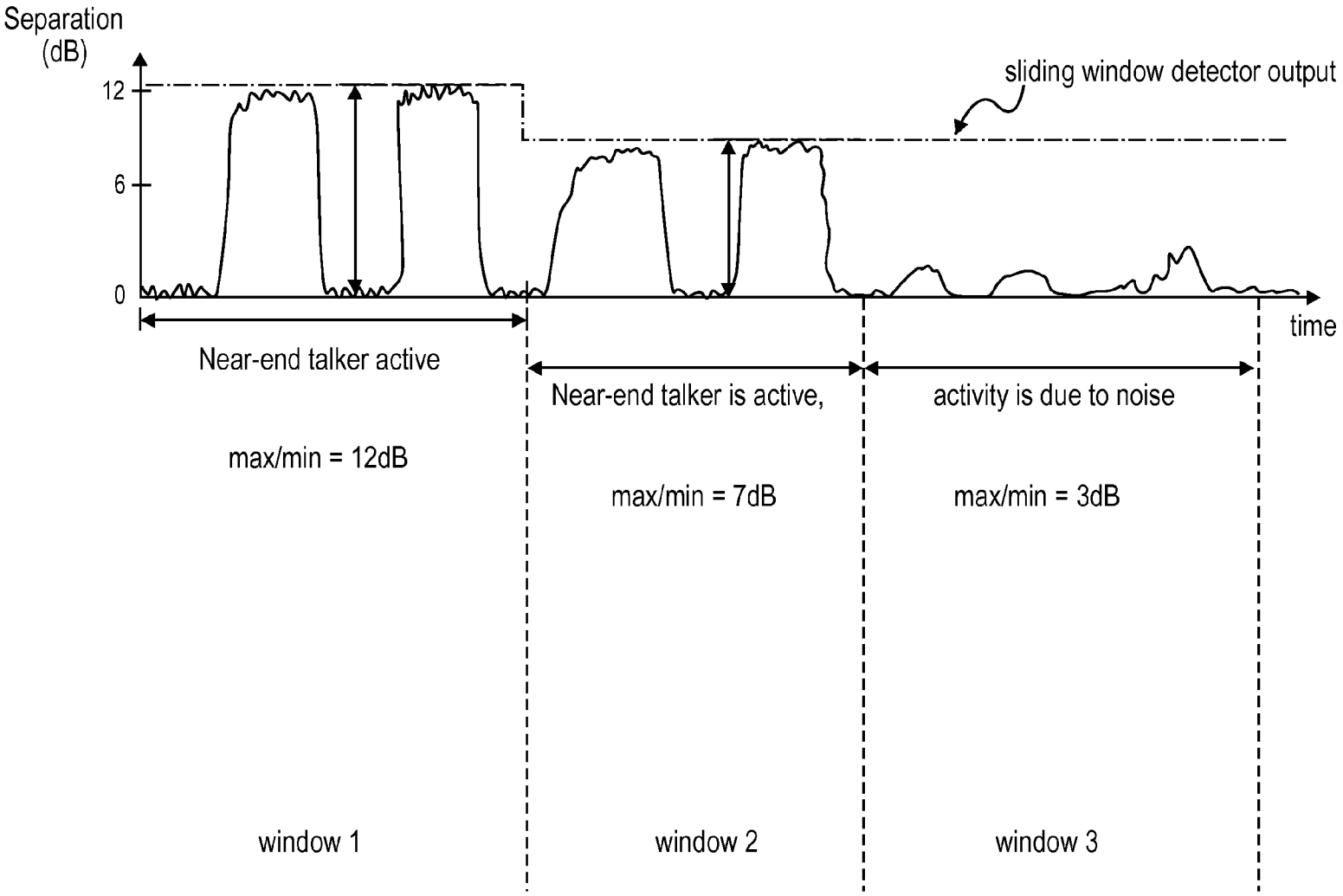
FIG. 7 shows a plot of the output of an example sliding window min-max detector superimposed on its input, separation vs. time curve.

FIG. 7 shows a plot of an example separation data vs. time curve, superimposed with the results of a sliding window detector that is operating upon the separation data. It can be seen that in window 1, during which the near end talker is active, a max/min of about 12 dB is measured (the peak separation), while in the subsequent window, window 2, the measured max/min drops to about 7 dB. Thereafter in window 3, there is no meaningful near end speech activity, and the max/min measured there is about 3 dB. Setting a detector threshold of about 5 dB will result in the following detector outputs: for window 1, the output is 12 dB; for window 2, the output is 7 dB; and for window 3, the output is 7 dB (i.e., the min-max measurement in window 3 is rejected and so the detector output remains unchanged from what it was for window 2). The detector output for this example sequence of windows is shown. Contrast this with the output of the leaky peak capture function described above in which the output is allowed to immediately to decay over time (starting from a captured peak value).

It should be noted here that an update to the output of the sliding window peak detector can go in either direction, i.e. there can be a sudden drop in the output as seen in window 2, e.g. due to a suitable min-max transition having been found whose maximum value happens to be smaller than the previous or existing output of the detector. Also, for a given sequence of windows, the lengths of the time intervals of the windows can vary and need not be fixed; in addition, there may be some time overlap between consecutive windows.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, although the threshold adaptation techniques described above may be especially advantageous for use in a VAD process that is part of a noise estimation process, the techniques could also be used in VAD processes as part of other speech processing applications. Also, while the two audio channels were described as being sound pick-up channels that use acoustic microphones, in some cases a non-acoustic microphone or vibration sensor that detects a bone conduction of the talker, may be added to form the primary sound pick up channel (e.g., where the output of the vibration sensor is combined with that of one or more acoustic microphones). In another aspect, peak analysis of the separation may alternatively use a more sophisticated pattern recognition or machine language algorithm. The description is thus to be regarded as illustrative instead of limiting.

What is claimed is:

1. A method for adapting a threshold used in multi-channel audio noise estimation, comprising, wherein the separation is computed on a per frequency bin and on a per time frame basis as a sequence of discrete-time vectors, each vector having one or more frequency bins and corresponding to a respective time frame of digital audio:

computing strength of a primary sound pick up channel;

computing strength of a secondary sound pick up channel;

computing separation versus time, being a measure of difference between the strengths of the primary and secondary channels;

analyzing a plurality of peaks in the separation versus time, wherein analyzing a plurality of peaks comprises computing a leaky peak capture function of the separation by updating a current value of the function to a new value in accordance with the separation being greater than a previous value of the function, wherein the leaky peak capture function captures a peak in the separation and then decays over time; and adjusting a threshold that is to be used in an audio noise estimation process in accordance with the leaky peak capture function of the separation, wherein the threshold is an audio signal strength value.

2. The method of claim 1 wherein analyzing a plurality of peaks comprises using a sliding window min-max detector to capture a peak in the separation.

3. The method of claim 1 wherein the threshold is a voice activity detector (VAD) threshold that is used in the audio noise estimation process.

4. The method of claim 1 in combination with the audio noise estimation process, wherein the audio noise estimation process comprises:

generating a noise estimate predominantly from the secondary channel and not the primary channel, when strength of the primary channel is greater, as per the threshold, than strength of the secondary channel.

5. The method of claim 4 wherein the audio noise estimation process further comprises:

generating the noise estimate predominantly from the primary channel and not the secondary channel, when strength of the primary channel is not greater, as per the threshold, than strength of the secondary channel.

6. The method of claim 1 in combination with the audio noise estimation process, wherein the audio noise estimation process comprises:

generating a noise estimate predominantly from the primary channel and not the secondary channel, when strength of the primary channel is not greater, as per a threshold, than strength of the secondary channel.

7. The method of claim 6 wherein the noise estimate, strengths of the primary and secondary channels, and separation are in spectral domain.

8. The method of claim 1 wherein each of the noise estimate, strengths of the primary and secondary channels, and separation comprises a sequence of discrete-time vectors, wherein each vector has a plurality of values associated with a plurality of frequency bins and corresponds to a respective frame of digital audio.

9. The method of claim 1 wherein computing the leaky peak capture function further comprises computing a probability of speech, wherein the current value of the function is updated to the new value when the probability of speech is high but not when the probability of speech is low.

10. A method for adapting a threshold used in multichannel audio voice activity detection, comprising:

computing strength of a primary sound pick up channel;

computing strength of a secondary sound pick up channel;

computing separation versus time, being a measure of difference between the strengths of the primary and secondary channels, wherein the separation is computed on a per frequency bin and on a per time frame basis as a sequence of discrete-time vectors, each vector having one or more frequency bins and corresponding to a respective time frame of digital audio;

analyzing a plurality of peaks in the separation versus time, wherein analyzing a plurality of peaks comprises computing a leaky peak capture function of the separation by updating a current value of the function to a new value in accordance with the separation being greater than a previous value of the function, wherein the leaky peak capture function captures a peak in the separation and then decays over time; and adjusting a threshold that is to be used in a voice activity detection (VAD) process in accordance with the leaky peak capture function of the separation, wherein the threshold is an audio signal strength value.

11. The method of claim 10 wherein analyzing a plurality of peaks comprises using a sliding window min-max detector to capture a peak in the separation.

12. The method of claim 10 wherein computing the leak peak capture function further comprises:

computing a probability of speech, wherein the current value of the function is updated to the new value when the probability of speech is high but not when the probability of speech is low.

13. The method of claim 10 wherein adjusting the threshold comprises computing the threshold as a linear combination of a current peak separation value, given by the analysis, and a margin value, and wherein the computed threshold is to remain between pre-determined lower and upper bounds.

14. The method of claim 10 wherein the strengths of the primary and secondary channels and separation are in spectral domain.

15. The method of claim 10 wherein each of the strengths of the primary and secondary channels and separation comprises a sequence of vectors, wherein each vector has a plurality of values associated with a plurality of frequency bins and corresponds to a respective frame of digital audio.

16. The method of claim 10 wherein the threshold comprises a sequence of vectors, wherein each vector has a plurality of values associated with a plurality of frequency bins and corresponds to a respective frame of digital audio.

17. An audio device comprising:

a first microphone positioned near a user's mouth;

a second microphone positioned far from the user's mouth; and audio signal processing circuitry coupled to the first and second microphones, the circuitry to compute separation, being a measure of how much a strength of a signal produced by the first microphone is different than the strength of a signal produced by the second microphone, wherein the separation is a sequence of discrete-time vectors, each vector having one or more frequency bins and corresponding to a respective time-frame of digital audio, and analyze a plurality of peaks in the separation, wherein analyzing a plurality of peaks comprises computing a leaky peak capture function of the separation by updating a current value of the function to a new value in accordance with the separation being greater than a previous value of the function, wherein the leaky peak capture function captures a peak in the separation and then decays over time, wherein the circuitry is to adjust a voice activity detection (VAD) threshold in accordance with the leaky peak capture function of the separation, wherein the VAD threshold is an audio signal strength value.

18. The audio device of claim 17 wherein the audio signal processing circuitry is to analyze the plurality of peaks using a sliding window min-max detector to capture a peak in the separation.

19. The device of claim 17 wherein the first microphone is a bottom microphone and the second microphone is a top microphone integrated in a mobile phone housing and in which the audio signal processing circuitry is also integrated.

20. The device of claim 19 wherein the audio signal processing circuitry is to adjust the voice activity detection (VAD) threshold in accordance with the analysis of the peaks during a phone call and while the user is participating in the call with the mobile phone housing positioned in handset mode.

21. The device of claim 17 wherein the circuitry is to compute a probability of speech in the signal produced by the first microphone, and update the current value of the leaky peak capture function to the new value, when the probability of speech is high but not when the probability of speech is low.

22. The device of claim 17 wherein the circuitry is to adjust the threshold by computing the threshold as a linear combination of a current peak separation value, given by the analysis, and a margin value, and wherein the computed threshold is to remain between pre-determined lower and upper bounds.

* * * * *